US005287674A

United States Patent [19]

Sperber

[11] Patent Number: 5,287,674

[45] Date of Patent: Feb. 22, 1994

[54] METHOD AND APPARATUS FOR CONTAINING INSULATION USING A BARRIER ASSEMBLY

[76] Inventor: Henry Sperber, 8 Red Fox La., Englewood, Colo. 80111

[21] Appl. No.: 744,428

[22] Filed: Aug. 13, 1991

[51] Int. Cl.[5] ..... E04B 1/74

[52] U.S. Cl. ..... 52/743; 52/404

[58] Field of Search ..... 52/743, 404; 55/528

[56] References Cited

U.S. PATENT DOCUMENTS

| | | | |
|---|---|---|---|
| 2,235,542 | 3/1941 | Wenzel | 72/16 |
| 2,788,552 | 4/1957 | Miles | 52/743 |
| 2,989,790 | 6/1961 | Brown | 52/743 |
| 3,815,341 | 6/1974 | Hamano | 55/528 |
| 4,016,702 | 4/1977 | Nakada et al. | 52/743 |
| 4,134,242 | 1/1979 | Musz et al. | 52/743 |
| 4,177,618 | 12/1979 | Felter | 52/743 |
| 4,385,477 | 5/1983 | Walls et al. | 52/743 |
| 4,399,645 | 8/1983 | Murphy et al. | 52/743 |
| 4,712,347 | 12/1987 | Sperber | 52/743 |
| 4,829,738 | 5/1989 | Moss | 52/404 |

*Primary Examiner*—Carl D. Friedman
*Assistant Examiner*—Christopher T. Kent
*Attorney, Agent, or Firm*—Sheridan Ross & McIntosh

[57] ABSTRACT

An apparatus and a method are provided to retain loose fill or particulate insulation between the outer and inner walls of a structure. The apparatus comprises a barrier assembly comprised of laminate layers of a netting material and a polypropylene material both with some degree of flexibility. The netting material is constructed to strengthen the polypropylene material and bulge slightly when a desired amount of insulation has been received and positioned within an enclosed space of the wall structure. The polypropylene material is constructed to be substantially air permeable but substantially impermeable to the passage of all size fractions of insulating fibers and other particulates typically found in insulation materials.

11 Claims, 2 Drawing Sheets

METHOD AND APPARATUS FOR CONTAINING INSULATION USING A BARRIER ASSEMBLY

FIELD OF THE INVENTION

The present invention relates to an apparatus and method for retaining loose fill insulation within walls of a structure and, more particularly, to an air permeable barrier assembly that is substantially impermeable to the passage of insulating fibers and other fine particulates.

BACKGROUND OF THE INVENTION

An increasingly preferred method of installing insulation into a building or residential structure is the method of 37 blowing in" or spraying insulation particles mixed with adhesive into the space between the outer and inner walls of the structure. The aggregate of insulation fibers and the adhesive is typically referred to as loose fill insulation.

Since the outer walls of a structure are normally installed before the inner walls, it is desirable to 37 blow in" the loose fill insulation prior to the construction of the inner walls. In this manner, no access holes for insulation installation need be placed in the inner walls once the walls are constructed. Prior placement of loose fill insulation requires the use of some means to retain temporarily the insulation between the wall framing until the inner wall can be constructed to act as a permanent retaining barrier. The prior art teaches several methods and apparatuses to provide such a temporary retaining means.

U.S. Pat. No. 4,712,347 by Sperber discloses a method and an apparatus for attaching netting to the inner side of the vertically extending, spaced studs, from floor to ceiling, and then blowing in loose fill insulation through selected holes in the netting. As the loose fill insulation is delivered into the space, it compacts together and the numerous netting holes permit the air displaced by the deposited insulation to readily escape. The netting is so constructed that it will bow outward when sufficient loose fill insulation has been received in the wall space. In this manner, the netting attains the maximum insulating effect by insuring that the particles are neither so loosely compacted to cause the surrounding air space to dissipate the heat retention effect nor so tightly compacted that there is no supplemental insulating effect created by the air surrounding the particles. In the Sperber invention, however, the netting holes may permit fibers of insulation and other fine particulate . matter to be blown or escape into the air outside of the netting when the insulation is installed.

U.S. Pat. No. 4,177,618, by Felter, is directed to a method and apparatus for installing insulation, wherein insulation is blown into vertical wall spaces formed between a permanent wall and a plastic membrane with the wall and membrane being separated and supported by the vertical studs in the structure. To prevent sagging of the membrane, which preferably is in the form of a relatively thin film or sheet of transparent plastic, the patent discloses the use of a transparent shield plate to support the membrane while the insulation is being delivered into place. The Felter invention, however, is not able to achieve the optimal density of loose fill insulation in the vertical wall spaces for the reasons that it does not employ an air permeable membrane to permit the escape of air displaced by inserted insulation particles and it does not use the sagging of the membrane as an indication of the insulation density, but uses a shield plate to prevent membrane sagging.

U.S Pat. No. 2,235,542, by Wenzel, discloses a method for installing insulation in which insulation is blown into vertical spaces formed between the outer wall and rigid laths. The wall and laths are separated and supported by the vertical studs of the structure. The Wenzel invention, however, is not a flexible barrier and permits insulation fibers and other fine particulate matter to escape through the spaces between the laths into the air outside of the laths when the insulation is installed.

Finally, U.S. Pat. No. 2,989,790, by Brown, discloses an apparatus and method for installing and packing insulation by blowing insulation into vertical spaces between the outer wall and a one inch expanded metal screen, optionally reinforced by a reinforcing strip, with the wall and screen being separated by the vertical studs of the structure. The removable screens hold the insulation in place as insulation is installed and packed into the vertical space to a desired density. Like the inventions of Sperber and Wenzel, however, the Brown invention may permit insulation fibers and other fine particulate matter to pass through the screen and escape into the surrounding atmosphere when the insulation is installed.

SUMMARY OF THE INVENTION

A method and an apparatus are disclosed for retaining loose fill insulation within floor to ceiling spaces formed between the inner and outer walls of a structure. The apparatus of the present invention comprises a barrier assembly that is substantially air permeable and substantially impermeable to fibers of loose fill insulation. In one embodiment, the barrier assembly consists of laminated layers of a netting member and a filter member. The netting member is composed of netting material arranged to provide a number of netting holes of substantially equal size. The netting member provides support for the filter member while bulging slightly when an appropriate amount of insulation has been received and positioned within the enclosed space. The filter member is substantially air permeable but substantially impermeable to the passage of all size fractions of fibers of loose fill insulation and other fine particulates typically found in insulation materials. In a preferred embodiment, the filter member is an inexpensive fabric consisting of non-woven polypropylene fibers.

The barrier assembly is adapted to be attached to the vertically extending, spaced studs which typically serve as the mounting frame for the inner walls of a structure. Prior to the mounting of the finished inner wall, the barrier assembly is attached to the inwardly facing side of the studs from floor to ceiling, so as to form a retaining barrier for loose fill insulation which is inserted between the barrier assembly and the previously mounted outer walls. The barrier assembly is oriented so that the netting member is located outwardly of the filter member relative to the loose fill insulation.

The present invention also includes a method for retaining loose fill insulation within vertically extending spaces formed between the inner and outer walls of a structure. In accordance with the method of the present invention, the barrier assembly of the present invention is secured to the inwardly facing sides of the spaced studs of the structure. The barrier assembly is cut to create an opening to receive a hose nozzle for use in delivery of the insulation. Loose fill insulation is delivered by the hose into the space between the barrier assembly and the inner surface of the outer wall. As the loose fill insulation is delivered into the space, it compacts together and the barrier assembly permits the air displaced by the deposited insulation to readily escape. The barrier assembly, however, does not permit insulation fibers or other fine particulates to escape as insulation is installed. Additionally, the barrier assembly is so constructed that it will bow outward when sufficient loose fill insulation has been received in the wall space. Thereafter, the operator can cut another hole in the barrier assembly to continue the delivery of loose fill insulation until the entire extent of the space is filled with insulation.

In the preferred embodiment of the invention, the netting member of the barrier assembly is provided having uniformly spaced horizontal rows and vertical columns of netting material. The overlapping rows and columns of netting material also form netting holes which permit the passage of air displaced by the loose fill insulation. By appropriately selecting netting material of a certain rigidity and by appropriately sizing the netting holes, the netting gives the barrier assembly sufficient rigidity to resist bowing or bulging until a proper density of loose fill insulation is deposited between the barrier assembly and the outer wall. Conversely, the netting member is sufficiently elastic so that the barrier assembly bows or bulges when an adequate quantity of insulation has been deposited.

DETAILED DESCRIPTION

Figure 1:
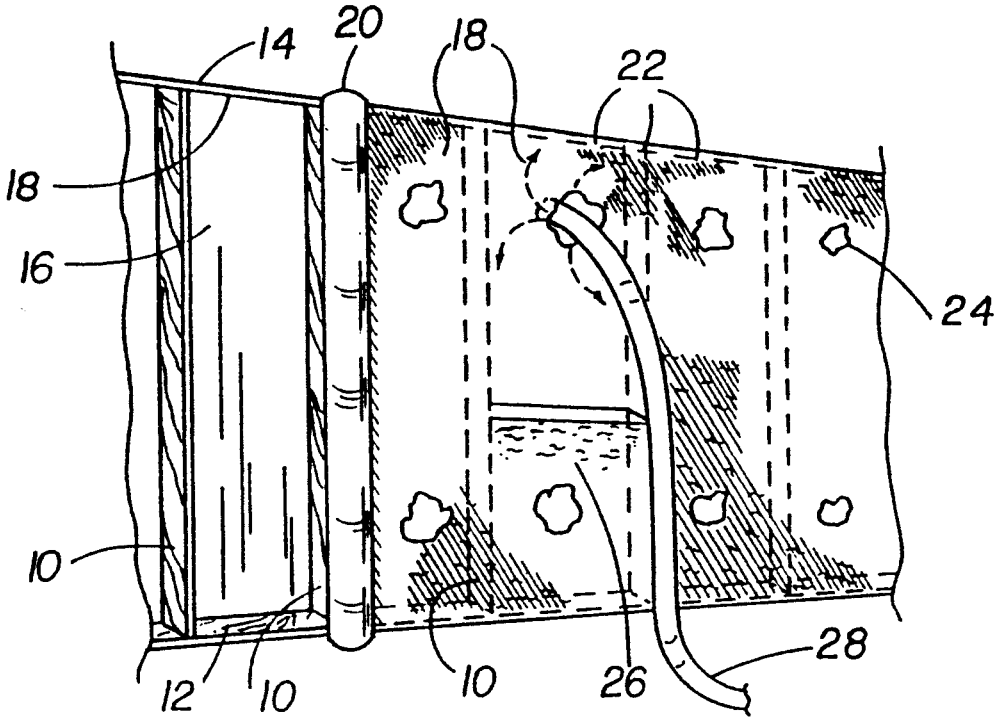
FIG. 1 is a perspective view of a structure illustrating the present invention.

The present invention relates to an apparatus and method for retaining loose fill insulation within walls of a structure by means of an air permeable barrier assembly that is substantially impermeable to the passage of insulating fibers and other fine particulates. With reference to FIG. 1, the support skeleton for the inner walls of a building structure includes a number of vertically extending studs 10 mounted between lower joists 12 and upper joists 14. The studs 10 are typically spaced uniformly from one another. An outer wall 16 is mounted to or abuts the outwardly facing sides of studs 10, lower joists 12 and upper joists 14. Accordingly, a number of wall spaces 18 opening towards the interior are formed between each adjoining pair of studs 10.

Once the outer wall 16 has been installed, it is desirable to place insulation in the wall spaces 18 before an inner wall is installed so that there is no need to later remove part of the inner wall to gain access to wall spaces 18. If the insulation choice is loose fill or particulate insulation, an appropriate apparatus is required to retain the particulate insulation in wall spaces 18. Loose fill insulation can be any of a variety of materials, including rockwool, cellulose, fiberglass, and ceramic fiber materials. In accordance with the present invention, a barrier assembly 20 is provided to retain the particulate insulation. The barrier assembly 20 is secured to the inwardly facing sides of the studs 10, lower joists 12 and upper joists 14 by securing pieces 22. Particulate or loose fill insulation 26 is inserted into spaces 18 through one or more access holes 24 formed in the barrier assembly 20. To insert the particulate insulation 26, a hose 28 is selectively inserted in the access holes 24. The hose 28 is connected to a source of insulation and preferably has a nozzle connected at its exit end to facilitate the injection of the particulate insulation 26 into the wall spaces 18.

Figure 2:
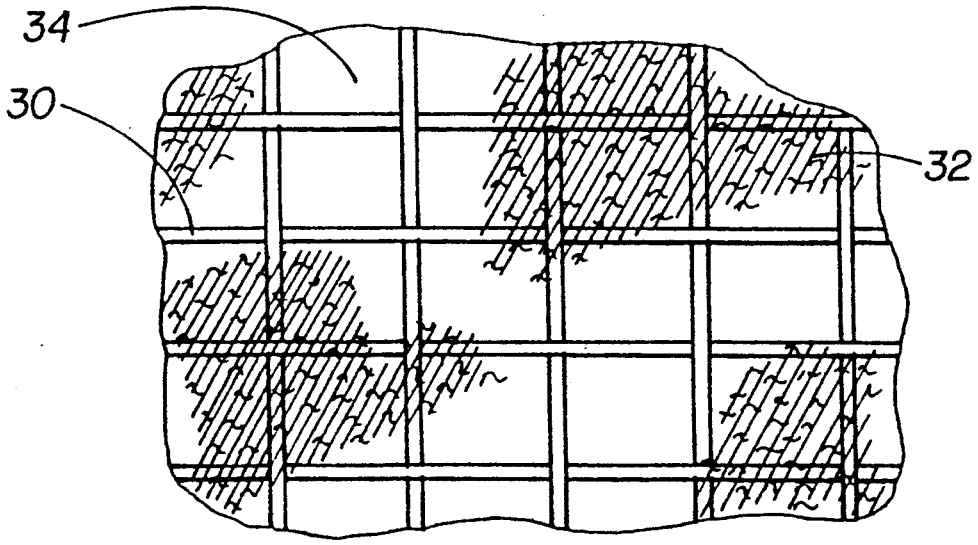
FIG. 2 is an enlarged, fragmentary view of a section of the barrier assembly illustrating the combination of the netting member and filter member.

The barrier assembly 20 is preferably provided in the form of a large cylindrical-shaped roll that includes over-lapping strips of barrier assembly material. As shown in FIG. 2, the barrier assembly 10 includes netting member 30 and a filter member 32 which are joined by lamination. The netting member 30 is illustrated in FIG. 2 as being in back of or behind the filter member 32 since this view looks outwardly in a direction from the wall space 18. The netting member is the netting disclosed in U.S. Pat. No. 4,712,347 by Sperber, entitled 37 Method and Apparatus Containing Insulation Using Netting". The netting member has a series of equally sized netting holes 34, as best seen in FIG. 2. The netting member 30 is so constructed as to provide a large number of netting holes 34, which are sufficiently small to prevent spillage of the blown in insulation. As stated above, in connection with U.S. Pat. No. 4,712,347, the netting holes 34 permit the escape not only of air displaced by the deposited insulation but may also allow the escape of insulation fibers and other fine particulate matter typically found in insulation materials.

The filter member 32, on the other hand, permits the escape of air displaced by the deposited insulation but not fibers of insulation and other fine particle matter typically found in insulation materials. The filter member 32, though air permeable, is substantially impermeable to substantially all of the size fractions of insulation fibers and other fine particulates. The filter member 32 prevents the escape of approximately 90% of the insulation fibers and other fine particulates which may escape through the netting holes 34.

The filter member 32 is a fabric consisting of soft, long, loosely packed, non-woven polypropylene fibers interconnected by heat treatment. The preferable polypropylene fibers are commercially marketed as LF/LW or CLAF/RFX and used in the upholstering of furniture. As will be known and understood by those skilled in the art, polypropylene fibers may be interconnected by any number of methods including weaving, knitting, pressure, and chemical action. The heat treated fabric is a light, thin material that does not by itself have sufficient strength to hold loose fill insulation since only a minimal amount of force is required to separate the loosely arranged polypropylene fibers. The fabric is relatively inexpensive and highly economical in comparison with other filter sheet materials. As will be known and understood by those skilled in the art, materials other than polypropylene may be used to create an air permeable barrier that is substantially impermeable to insulation fibers and other fine particulates, though the materials may not be as inexpensive and economical as polypropylene.

Figure 3:
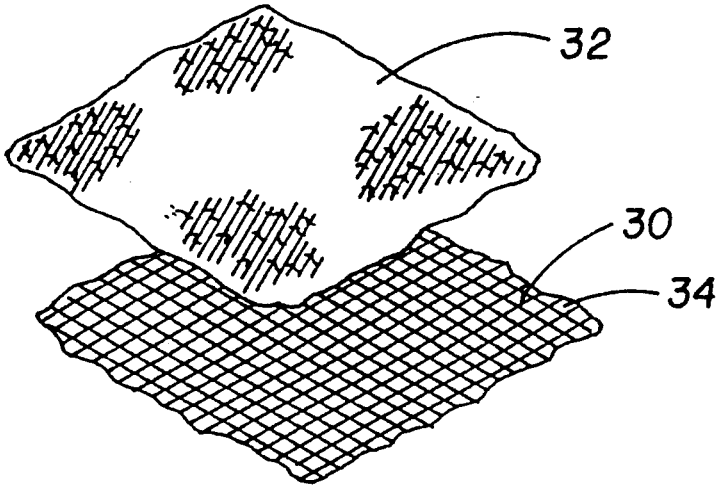
FIG. 3 is a perspective view of the netting member and filter member prior to lamination.
Figure 4:
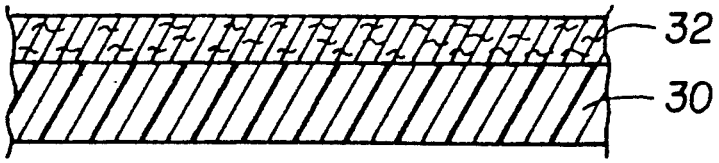
FIG. 4 is an enlarged, fragmentary cross-sectional view of the barrier assembly further illustrating the netting member and filter member.

As shown in FIGS. 3 and 4, the netting member 30 and filter member 32 are joined into a composite material by lamination to strengthen the filter member 32 and give the barrier assembly 20 sufficient strength to hold loose fill insulation in the desired wall space 18. In the lamination process, the netting member 30 is coated with adhesive, the filter member 32 is rolled over the netting member 30, and the assembly is heat treated for a sufficient period of time and at sufficient temperatures to complete lamination. In the process, there may be some shrinkage of the filter member 32. The resulting barrier assembly 20 is a novel combination of two inexpensive materials to produce a relatively inexpensive and highly economical alternative to other filter materials of sufficient strength by themselves to retain loose fill insulation.

The barrier assembly 20 is preferably installed with the filter member 32 facing inwardly, e.g., physically contacting the loose fill insulation 26. The netting member 30 is installed facing outwardly of the insulation and the filter member 32. If the netting member 30 were to face inwardly and the filter member 32 outwardly, the netting member 30 would not provide strength to the filter member 32 and when insulation is received into the wall spaces 18 there would be a force tending to cause separation and/or tearing of the filter member 32. In that event, the filter member 32 would contain undesirable holes permitting the possible escape of insulation fibers and other fine particulates.

The netting holes 34 and filter member 32 serve an important function during the insertion of the particulate insulation 26 by allowing the escape of air which is displaced by the inserted insulation particles. The maximum insulating effect with blown-in insulation occurs when the particles are neither so loosely compacted as to cause the surrounding air space to dissipate the heat retention effect nor so tightly compacted that there is no supplemental insulating effect created by the air surrounding the particles. By allowing displaced air to escape, the netting holes 34 and filter member 32 help the particulate insulation 26 to compact and achieve a desirable insulating capacity.

The apparatus of the present invention also provides an indication or signal that a sufficient amount of insulation 26 has been "blown" into the portion of the enclosed space 18 which underlies the access hole 24. Specifically, the barrier assembly 20 is adapted to bulge or bow out slightly away from the inside section of the structure when a sufficient density of insulation 26 has accumulated in the portion of an enclosed space adjacent to an access hole 24. To provide this desirable indicator function, the netting member 30 and the size of the strips should be selected to provide netting member 30 with resiliency to retain the blown in insulation 26 as well as flexibility to permit the netting to bulge slightly when an adequate amount of insulation has been inserted.

To install the insulation, the barrier assembly 20 is unrolled or unfolded over studs 10 with the filter member 32 facing inwardly and the netting member 30 facing outwardly. The barrier assembly 20 is secured to the studs by the securing pieces 22, which can be nails, staples or other appropriate fasteners. Also, the top and bottom of each section of the barrier assembly 20 are secured to upper joists 14 and lower joists 12, respectively. Consequently, each enclosed space 18 is bounded on all sides, either by outer wall 16, studs 10, lower joists 12, upper joists 14 or barrier assembly 20, so that the injected particulate insulation 26 can be retained within each enclosed space 18.

After the barrier assembly 20 has been secured across studs 10, access holes 24 are created so as to give access to any particular enclosed space 18. In a preferred arrangement, each hole 24 is located equidistant between two adjacent studs 10 to facilitate access to all portions of that part of enclosed space 18 which lies adjacent to the access hole 24. Each hole 24 can be created by widening one of the netting holes 34 or by cutting or tearing the barrier assembly 20 material at the time the insulation 26 is to be fed to the wall spaces 18.

The hose 28 is then inserted into an access hole 24 and the particulate insulation 26 is "blown" into the enclosed space 18. A preferred nozzle and process for supplying the insulation are described in U.S. Pat. No. 4,487,365 to Sperber, issued Dec. 11, 1984 and entitled "Reduced Fiber Insulation Nozzle." While the insulation 26 is being blown in, the newly inserted insulation displaces air in the enclosed space 18. The displaced air is propelled outward through the barrier assembly 20 towards the interior of the building structure. Typically, not all of the enclosed air is displaced, however, and the remaining air combines with the particulate insulation 26 to provide an effective insulating barrier.

When an adequate amount of particulate insulation 26 has been inserted below an access hole 24, the barrier assembly 20 bulges or bows out slightly (about 0.5–1 inch) to indicate to the user that the hose 28 should be withdrawn and moved to another access hole. The bulging or bowing effect need only be slight and will not later hinder the installation of the inner wall onto studs 10. As also can be seen in FIG. 1, the access holes 24 need not be covered after the insulation is in place thereby resulting in a further time savings for the installer. Additionally, the netting need not be heated or modified in any way to properly maintain the fed insulation in the wall spaces 18 thereby reducing the installation time.

The present invention provides a number of advantages. First, the barrier assembly is easily installed and requires no further handling once it is secured to the structure. Second, material costs are reduced as the barrier assembly requires less material than other insulation retaining apparatuses. Third, the barrier assembly of the present invention allows the insulation fibers to compact to a desirable density by allowing displaced air to exit as the insulation is inserted. Fourth, the barrier assembly alerts the insulation installer that an appropriate amount of insulation has been inserted. Finally and most importantly, the barrier assembly substantially prevents fibers of insulation and other fine particulates from passing through the barrier assembly into the surrounding atmosphere during installation of the insulation.

Although the present invention has been described with reference to a particular embodiment, it should be appreciated that variations and modifications can be effected within the spirit and scope of this invention.

What is claimed is:

1. A method for placing loose fill insulation in a support frame of a building in which the insulation includes fibers having fiber portions, comprising:

forming a support frame for receiving loose fill insulation;

providing filter means including a plurality of fibers joined together using heat to define a fabric wherein said fabric is a light, thin material having by itself insufficient strength to hold the loose fill insulation in said support frame, said filter means having first sized passages for controlling the passage of fiber portions therethrough and permitting passage of air;

providing netting means having a plurality of netting holes with said netting holes having second sized passages greater than said first sized passages of said filter means wherein at least some of said first sized passages overlie said second sized passages, said netting means being made separately from said filter means with said netting means connected to said filter means to define barrier means;

attaching said barrier means to said support frame;

forming at least a first access hole in said barrier means;

feeding the loose fill insulation between said barrier means and a portion of said support frame using said first access hole;

permitting air to escape through said barrier means preventing substantially the escape of fiber portions of the loose fill insulation through said barrier means using said filter means;

observing that a sufficient amount of loose fill insulation has been fed between said barrier means and said portion of said support frame; and discontinuing said feeding of the loose fill insulation.

2. A method, as claimed in claim 1, wherein:

said filter means is substantially air permeable and substantially impermeable to the passage of substantially all fiber portions of the loose fill insulation.

3. A method, as claimed in claim 1, wherein:

said filter means includes a plurality of non-woven fibers.

4. A method, as claimed in claim 1, wherein:

said netting means does not substantially contact the loose fill insulation.

5. A method, as claimed in claim 1, wherein:

said observing step includes determining when said barrier means bows outward from said support frame.

6. A method, as claimed in claim 5, wherein:

said discontinuing step includes discontinuing of said feeding of the loose fill insulation after said barrier means bows outwardly.

7. An apparatus for providing loose fill insulation in a building in which the insulation includes fibers having fiber portions, comprising:

a support frame; and barrier means connected to said support frame for use in containing loose fill insulation including fibers and portions thereof, said barrier means including filter means that is air permeable and substantially impermeable to the passage of substantially all portions of the insulation fibers, said filter means having first sized passages for controlling the passage of fiber portions therethrough and permitting the escape of air and said barrier means including netting means that includes netting holes, said netting holes having second sized passages greater than said first sized passages of said filter means, said netting means providing strength to said filter means, said filter means being made of a fabric wherein said fabric is a light, thin material having insufficient strength by itself to hold the loose fill insulation, portions of said filter means having said first sized passages overlying said netting means holes having said second sized passages wherein said first sized passages are able to prevent escape of fiber portions that are able to pass through said second sized passages, said netting means being made separately from said filter means but being connected thereto, at least a first access hole also being provided in said barrier means.

8. An apparatus, as claimed in claim 7, wherein:

said filter means includes a plurality of non-woven fibers joined together, with said non-woven fibers laminated to said netting means along substantially all portions of said non-woven fibers.

9. An apparatus, as claimed in claim 7, wherein:

said filter means includes a plurality of non-woven fibers joined together using heat before being connected to said netting means.

10. An apparatus, as claimed in claim 7, wherein:

said filter means is located contiguously of the loose fill insulation disposed behind said barrier means and said netting means is located outwardly of said filter means and the loose fill insulation.

11. An apparatus, as claimed in claim 7, wherein:

said filter means has a first thickness and said netting means has a second thickness with said second thickness being greater than said first thickness.

* * * * *